US005787709A

United States Patent [19]

Watanabe et al.

[11] Patent Number: 5,787,709

[45] Date of Patent: Aug. 4, 1998

[54] EXHAUST MANIFOLD

[75] Inventors: Yoshimasa Watanabe, Shunto-gun; Taro Ikeya, Okazaki, both of Japan

[73] Assignee: Toyota Jidosha Kabushiki Kaisha, Aichi, Japan

[21] Appl. No.: 772,619

[22] Filed: Dec. 23, 1996

[30] Foreign Application Priority Data

Dec. 26, 1995 [JP] Japan ..... 7-339005

[51] Int. Cl.[6] ..... F01N 7/10

[52] U.S. Cl. ..... 60/313; 60/323

[58] Field of Search ..... 60/313, 323

[56] References Cited

U.S. PATENT DOCUMENTS

| | | | |
|---|---|---|---|
| 2,841,951 | 7/1958 | Whitcomb | 60/313 |
| 3,670,844 | 6/1972 | Penfold | 60/313 |
| 3,726,084 | 4/1973 | Meier | 60/313 |
| 4,815,274 | 3/1989 | Piatti | 60/313 |

FOREIGN PATENT DOCUMENTS

| | | | |
|---|---|---|---|
| 284466 | 9/1988 | European Pat. Off. | 60/313 |
| 5-1819 | 1/1993 | Japan . | |
| 5-12623 | 2/1993 | Japan . | |

OTHER PUBLICATIONS

Copending U.S. Patent Application Serial No. 626,737.

*Primary Examiner*—Douglas Hart
*Attorney, Agent, or Firm*—Kenyon & Kenyon

[57] ABSTRACT

An exhaust manifold of which each exhaust port is formed by a pipe member is disclosed. Each pipe member at one end portion has a wedge shape section. Each pipe member at the other end portion is connected to the cylinder head of an engine. The pipe members are abutted one another in the one end portion to form the merging portion of the exhaust manifold. A plurality of radial partition walls are formed in the merging portion by joining end surfaces of the pipe members one another. In the exhaust manifold, two adjacent partition walls among the partitions walls are arranged almost symmetrically around a plane which passes through the center of the merging portion and is parallel to a direction in which the largest force is generated by thermal expansions of the exhaust ports.

14 Claims, 8 Drawing Sheets

EXHAUST MANIFOLD

BACKGROUND OF THE INVENTION

1. Field of the Invention

The present invention relates to an exhaust manifold of which each exhaust port is formed by use of a pipe member.

2. Description of the Related Art

A usual exhaust manifold is formed by casting iron. Such an exhaust manifold is very heavy. To make an exhaust manifold light and to realize a reduced cost thereof, it is suggested that each exhaust port of the exhaust manifold is formed by use of a steel pipe, for example a stainless steel pipe. The light exhaust manifold has a small heat capacity so that a catalytic converter can also be warmed up rapidly. In such exhaust manifold, each pipe member has a sector section at the merging portion. The sector section portions of the pipe members are abutted one another and are inserted into a single outer pipe at the merging portion of the exhaust manifold.

The exhaust manifold is firmly fixed to the cylinder head of an engine at the end of each exhaust port. Therefore, once the high temperature exhaust gas passes through the exhaust manifold, each exhaust port is expanded by the heat thereof so that the merging portion of the exhaust manifold is deformed. In general, each exhaust port is inwardly expanded by heat, i.e., toward the merging portion of the exhaust manifold in the arrangement direction of the fixed ends of the exhaust ports. Therefore, the merging portion of the exhaust manifold is deformed largely in the arrangement direction.

Japanese Unexamined Utility Model Publication No. 5-1819 discloses that each partition wall at the merging portion of the exhaust manifold, i.e., a part of the side wall of each pipe member at the merging portion is curved plastically. Therefore, once a force toward the merging portion of the exhaust manifold acts on the partition walls, each partition wall becomes more curved and thus an approximately uniform bending stress is generated on the partition wall generally.

According to the above prior art, a stress concentration does not occur on each partition wall so that the partition wall is not broken down by the thermal expansion thereof. However, a force generated in the above-mentioned arrangement direction by the thermal expansion of each exhaust port is large in comparison with a force due to the thermal expansion of each partition wall. As a result, if the stress concentration does not occur, a very large bending stress is generated on the partition wall which is parallel to the arrangement direction. Therefore, the partition wall can be broken and thus exhaust gas can leak from the merging portion of the exhaust manifold.

SUMMARY OF THE INVENTION

Therefore, an object of the present invention is to provide an exhaust manifold, of which each exhaust port is formed by use of a pipe member, which can surely prevent breaking of each partition wall of the merging portion due to the thermal expansion of each exhaust port.

According to the present invention, there is provided an exhaust manifold of which each exhaust port is formed by a pipe member, each pipe member at one end portion has a wedge shape section, each pipe member at the other end portion is connected to the cylinder head of an engine, the pipe members are abutted one another in the one end portion to form the merging portion of the exhaust manifold, a plurality of radial partition walls are formed in the merging portion by joining the end surfaces of the pipe members one another, wherein two adjacent partition walls among the partitions walls are arranged almost symmetrically around a plane which passes through the center of the merging portion, and are parallel to a direction in which the largest force is generated by thermal expansions of the exhaust ports.

The present invention will be more fully understood from the description of the preferred embodiments of the invention as set forth below, together with the accompanying drawings.

DESCRIPTION OF THE PREFERRED EMBODIMENTS

Figure 1:
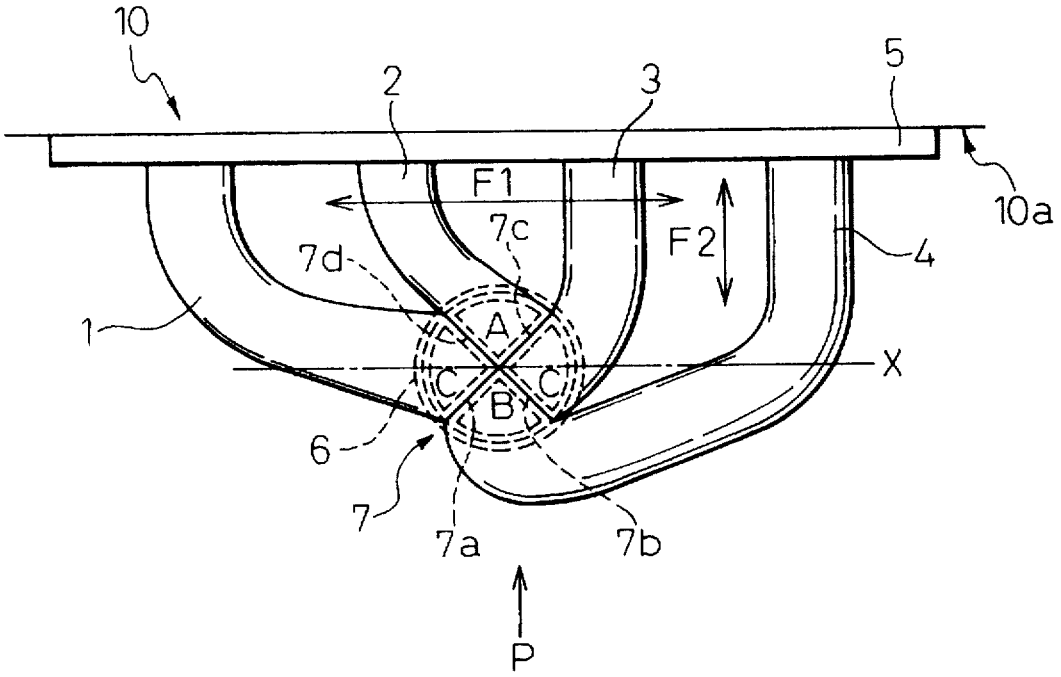
FIG. 1 is a plan view showing a first embodiment of an exhaust manifold according to the present invention.
Figure 2:
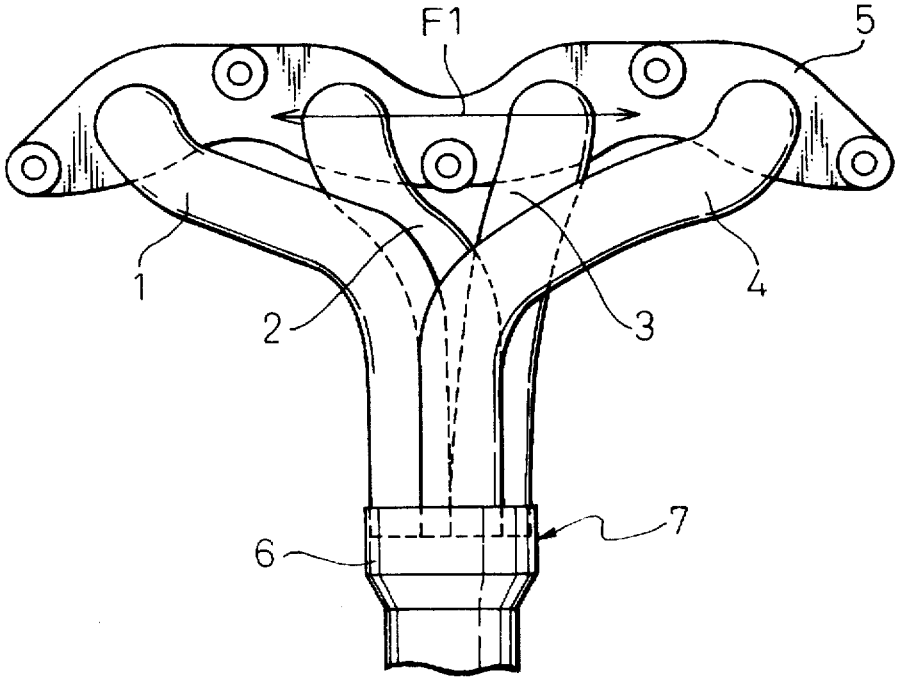
FIG. 2 is a view of FIG. 1 from the direction of the arrow P.

FIG. 1 is a plan view showing a first embodiment of an exhaust manifold according to the present invention. FIG. 2 is a view of FIG. 1 from the direction of the arrow P. Referring to FIGS. 1 and 2, the exhaust manifold is for a 4-cylinder engine, and has first, second, third, and fourth exhaust ports 1, 2, 3, 4. Each exhaust port is formed by use of a steel pipe, for example a stainless steel pipe which is bent to desired shape. The upper end of each exhaust port 1, 2, 3, 4 is fixed to a flange 5 by welding or the like. The lower portions of the exhaust ports extend almost vertically, and have a sector-shaped cross-section having a central angle of about 90 degrees, are abutted one another, and are inserted into a single outer pipe 6. Thus a merging portion 7 of the exhaust manifold is formed.

The two flat side walls of the lower portion of each exhaust port 1, 2, 3, 4, which walls intersect each other at about 90 degrees, are paired with flat side walls of the adjacent exhaust ports, and each pair of side walls becomes a partition wall 7*a*, 7*b*, 7*c*, 7*d*, which extends radially from a center of the merging portion 7. Each partition wall 7*a*, 7*b*, 7*c*, 7*d* intersects with a mounting surface 10*a* of the cylinder head 10, to which the flange 5 is mounted, at about 45 degrees.

The exhaust manifold is fixed to the cylinder head 10 via the flange 5. Accordingly, once a high temperature exhaust gas passes through the exhaust manifold, each exhaust port 1, 2, 3, 4 is expanded by heat thereof so that the merging portion 7 of the exhaust manifold is deformed.

In the arrangement direction F1 of the upper fixed end of each exhaust port 1, 2, 3, 4, each exhaust port 1, 2, 3, 4 is expanded by heat toward the merging portion 7 so that a very large force in the arrangement direction F1 acts on the merging portion 7. On the other hand, in a direction F2 at right angles to the mounting surface 10*a* of the cylinder head 10, since all exhaust ports 1, 2, 3, 4 are expanded by heat in the same direction, a force acted on the merging portion 7 is small. Therefore, a section of the merging portion 7 is deformed into an approximately ellipse shape which has a minor axis of the arrangement direction F1.

In each partition wall 7*a*, 7*b*, 7*c*, 7*d* of the merging portion 7, it is hard to radiate heat so that the temperature thereof becomes high and the strength thereof drops. In particular, the temperature close to the center of the merging portion 7 in each partition wall becomes very high and the strength thereof drops considerably. Therefore, if the two partition walls 7*b*, 7*d* in the merging portion 7 are parallel to the mounting surface 10*a* of the cylinder head 10 as the prior art, the above-mentioned very large force in the arrangement direction F1 acts on these two partition walls and these walls, of which the strength drops, are easily broken. However, in the present embodiment, each partition wall 7*a*, 7*b*, 7*c*, 7*d* intersects with the mounting surface 10*a* of the cylinder head 10 at about 45 degrees so that the very large force is carried uniformly on these four partition walls and thus the partition walls is not broken.

In the present embodiment, the merging portion 7 of the exhaust manifold extends almost vertically. However, in the case that the merging portion 7 inclines, each partition wall intersects with a plane which is parallel to the arrangement direction F1 and passes through the center of the merging portion 7 at about 45 degrees. Therefore, the force in the arrangement direction F1 can be carried uniformly on the four partition walls.

Figure 3:
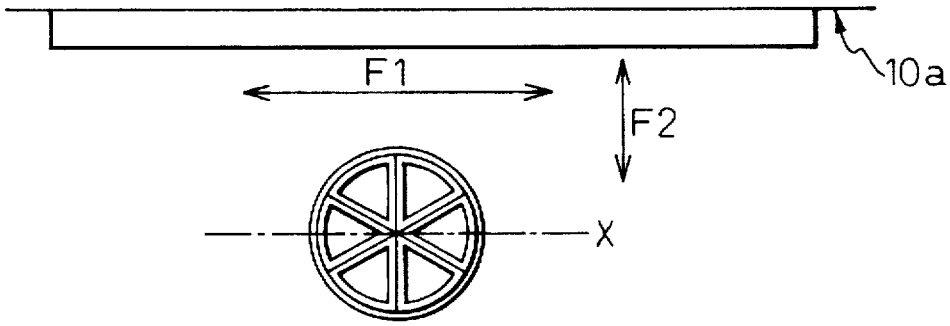
FIG. 3 is a horizontal sectional view of the merging portion when the exhaust manifold is for use with a six-cylinder engine, as a variation of the first embodiment.

Moreover, in the present embodiment, the exhaust manifold is for a four-cylinder engine. Accordingly, the lower portion of each exhaust port 1, 2, 3, 4 is made the sector section having a central angle of about 90 degrees. However, for example, when the exhaust manifold is to be used for a six-cylinder engine, the lower portion of each exhaust port has a sector-shaped cross-section having a central angle of about 60 degrees. In this case, as shown in FIG. 3, any of four partition walls intersect a plane X which is parallel to the arrangement direction F1 and passes through the center of the merging portion at about 30 degrees. Therefore, the force in the arrangement direction F1 can be carried uniformly on these four partition walls.

Figure 4:
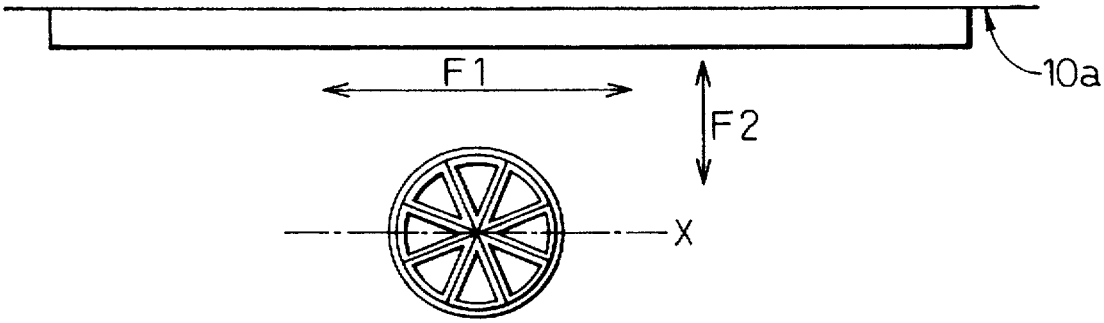
FIG. 4 is a horizontal sectional view of the merging portion when the exhaust manifold is for use with an eight-cylinder engine, as a variation of the first embodiment.
Figure 5:
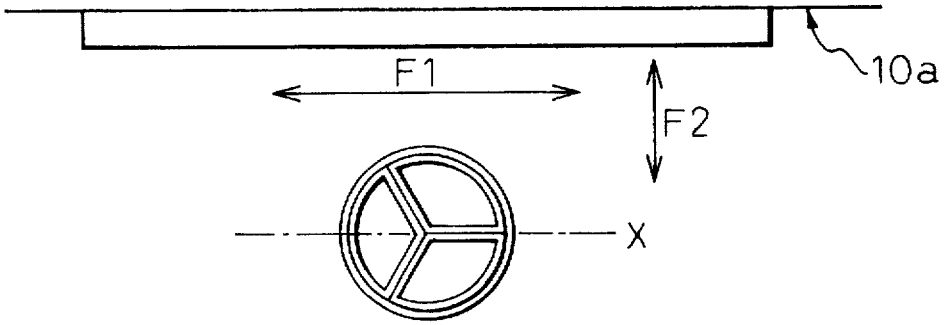
FIG. 5 is a horizontal sectional view of the merging portion when the exhaust manifold is for use with a three-cylinder engine, as a variation of the first embodiment.
Figure 6:
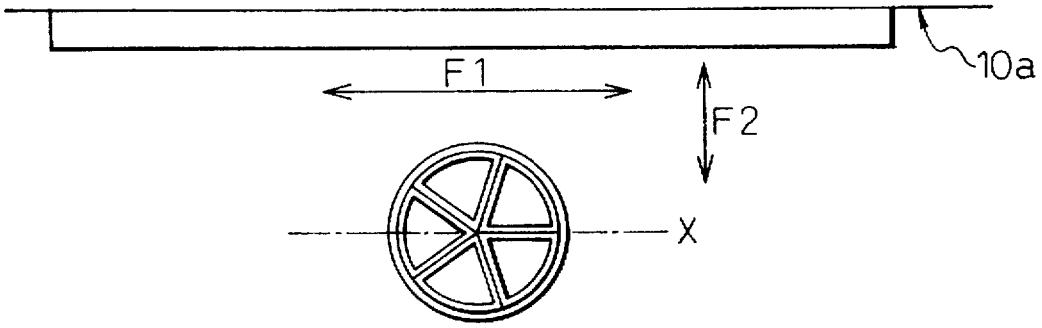
FIG. 6 is a horizontal sectional view of the merging portion when the exhaust manifold is for use with a five-cylinder engine, as a variation of the first embodiment.

In the case that the exhaust manifold is for use with an eight-cylinder engine, the lower portion of each exhaust port has a sector-shaped cross-section having a central angle of about 45 degrees. In this case, as shown in FIG. 4, any of four partition walls intersect with the plane X at about 22.5 degrees. Therefore, the force in the arrangement direction F1 can be carried uniformly on these four partition walls. In the case that the exhaust manifold is for an engine with an odd number of cylinders, any two adjacent partition walls are arranged symmetrically against the above-mentioned plane X. Therefore, the force in the arrangement direction F1 can be carried uniformly on these two partition walls and thus it can be prevented that any partition wall is broken. FIG. 5 shows the case when the exhaust manifold is for a three-cylinder engine. FIG. 6 shows the case when the exhaust manifold is for a five-cylinder engine.

Figure 7:
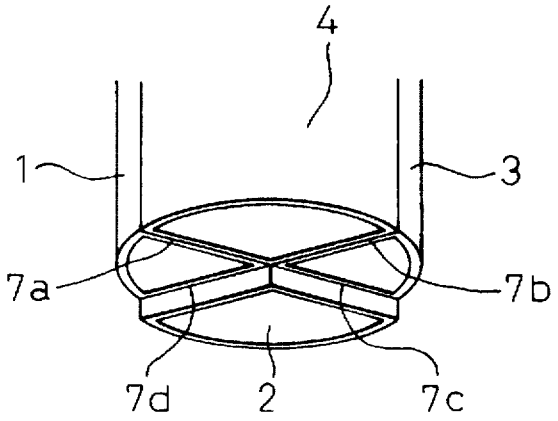
FIG. 7 is a perspective view showing the lower end of each exhaust port.

FIG. 7 is a perspective view showing the lower end of each exhaust port 1, 2, 3, 4. Referring to FIG. 7, only the end surface of the second exhaust port 2 is projected over the end surfaces of the other exhaust ports. The second exhaust port 2 is the shortest one. As above-mentioned, the lower portions of the exhaust ports 1, 2, 3, 4 abut one another and are inserted into the single outer pipe 6. A seal between the arc shape wall of each exhaust port 1, 2, 3, 4 and the outer pipe 6 is realized by fillet welding on the circumference of the upper end of the outer pipe 6. On the other hand, a seal between any two flat side walls of the pipe members which abut each other and a seal of the center portion are realized by the weld, as shown in FIG. 8(A), on the end surfaces of the exhaust ports.

Figure 8:
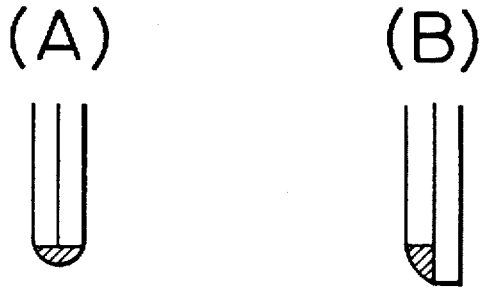
FIG. 8(A) shows a weld in the end surfaces of the exhaust port.
FIG. 8(B) shows a fillet weld in the end surfaces of the exhaust ports.

In the present embodiment, since only the end surface of the second exhaust port 2 is projected over the end surfaces of the other exhaust ports, the fillet weld can be carried out between the two flat side walls of the second exhaust port 2 and the two flat side walls abutting thereto, and on the center portion, as shown in FIG. 8(B). Therefore, these are sealed very well. Moreover, the two partition walls 7*c*, 7*d* formed by the fillet welding become stronger than the other partition walls 7*a*, 7*b* formed by the weld.

In the present embodiment, each partition wall intersects with the plane which is parallel to the arrangement direction F1 and passes through the center of the merging portion at about 45 degrees so that the exhaust ports in the merging portion of the exhaust manifold occupy a first position A which is closest to the cylinder block, a second position which faces to the first position A, and third and fourth positions C, D which are between the first and second positions A, B. The second exhaust port 2 which is the shortest one occupies on the first position A, and the fourth exhaust port 4 which is the longest one occupies on the second position B. The second exhaust port 2 is directed to the first position A from the cylinder block side. The fourth exhaust port 4 is directed to the second position B from the opposite side.

The second and fourth exhaust ports 2, 4 are also expanded by heat in direction F2 at right angles to the mounting surface 10*a* of the cylinder head 10. Since the second and fourth exhaust ports 2, 4 are directed to the first and second positions A, B, respectively as the above-mentioned, the second exhaust port 2 presses the merging portion 7 toward the center thereof and the fourth exhaust port 4 pulls the merging portion 7 so as to detach it from the cylinder head 10. Therefore, in addition to the above-mentioned very large force in the arrangement direction F1, a force in the direction F2 at right angles to the mounting surface 10*a* of the cylinder head 10 acts on each partition wall 7*a*, 7*b*, 7*c*, 7*d* due to the above-mentioned thermal expansion of the second and fourth exhaust ports 2, 4. The force in the direction F2 is smaller than the force in the arrangement direction F1 since the lengths of the second and fourth exhaust ports 2, 4 in this direction F2 are relative short.

In the partition walls 7*c*, 7*d*, a compressive stress generated by the force in the direction F1 increases due to the force in the direction F2 caused by the thermal expansion of the second exhaust port 2. On the other hand, in the partition walls 7*a*, 7*b*, a compressive stress generated by the force in the direction F1 decreases due to the force in the direction F2 caused by the thermal expansion of the fourth exhaust port 4. Accordingly, it is an advantage for the prevention of breaking of the partition walls that the partition walls 7*c*, 7*d* are made strong by the fillet welding, as above-mentioned.

For example, if in addition to the projection of the end surface of the second exhaust port 2, the end surface of the fourth exhaust port 4 is projected over or is retracted from the end surfaces of the other exhaust ports, the two partition walls 7*a*, 7*b* can be also formed by the fillet welding. In this case, to realize sealing of the center portion, welding in the vertical direction is required. However, the base of this welding is easily broken by a small bending moment so that such a construction of the end surfaces of the exhaust ports cannot be realized.

Thus, an end surface of anyone exhaust port is made to project so that the two partition walls formed by the two flat side walls of this exhaust port and two flat side walls abutting thereto can be made strong. It is preferable to select two partition walls which are made strong, because that is how the merging portion is deformed. For example, in the above-mentioned embodiment, the longest fourth exhaust port 4 is relatively long in a direction parallel to the mounting surface 10*a* of the cylinder head 10 so that a force which pivots the merging portion 7 can be generated by the thermal expansion of the fourth exhaust port 4. In this case, the stress which is generated in the partition wall 7*c*, 7*d* becomes large. Accordingly, in this case, it is preferable to make the partition walls 7*c*, 7*d* stronger by the projection of the end surface of the second exhaust port 2.

Figure 9:
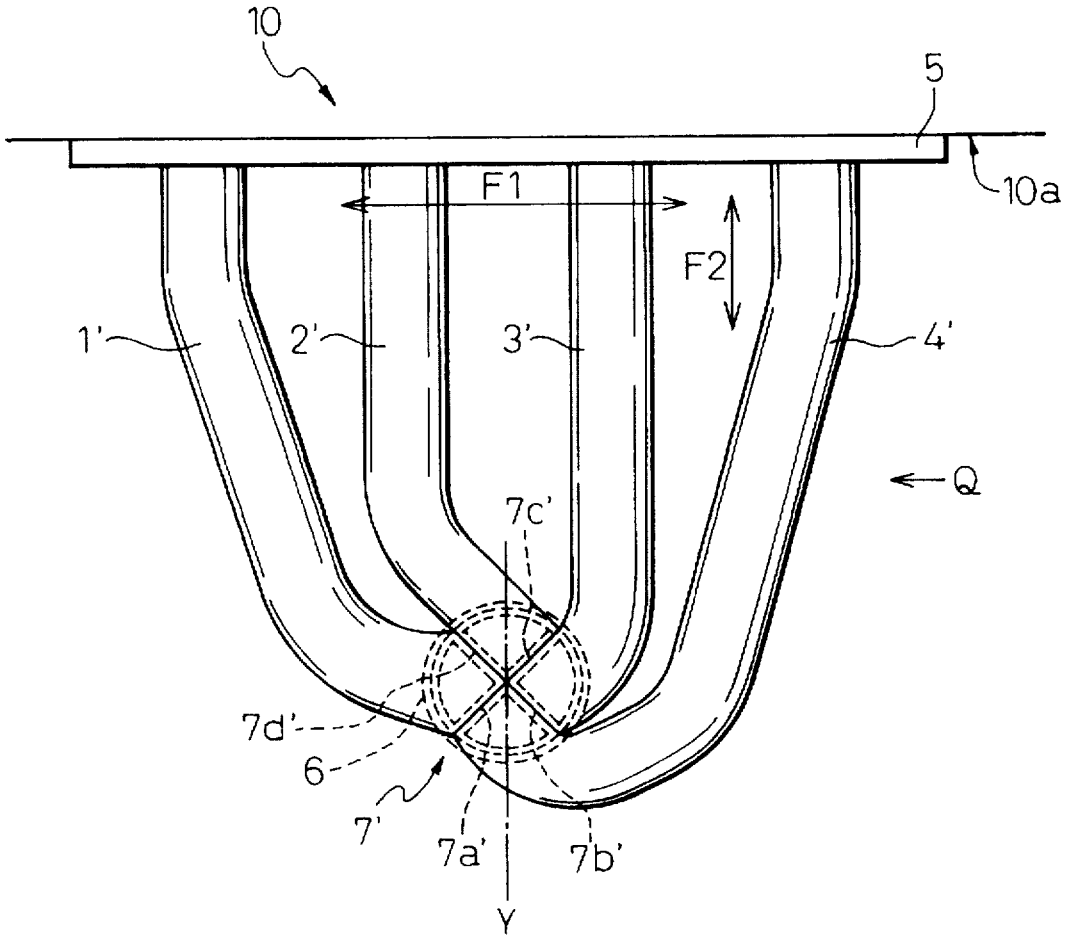
FIG. 9 is a plan view showing a second embodiment of an exhaust manifold according to the present invention.
Figure 10:
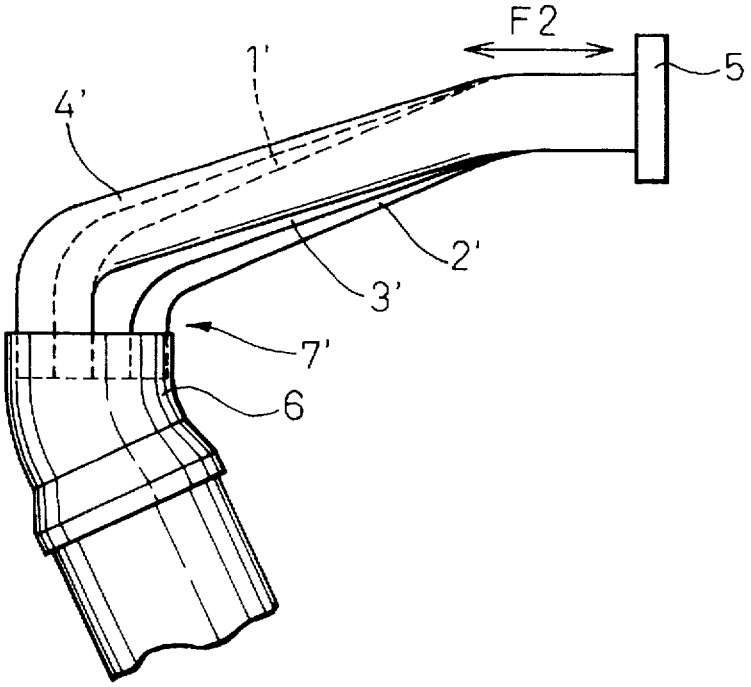
FIG. 10 is a view of FIG. 9 from the direction of the arrow Q.

FIG. 9 is a plan view of a second embodiment of an exhaust manifold according to the present invention. FIG. 10 is a view of FIG. 9 from the direction of arrow Q. The differences between the first embodiment and the second embodiment only will be explained. In the present embodiment, first, second, third, and fourth exhaust ports 1', 2', 3', 4' are relatively long in the direction F2 at right angles to the mounting surface 10*a* of the cylinder head 10. Accordingly, the merging portion 7' is further from the cylinder block than the one in the first embodiment.

In such an exhaust manifold, once each exhaust manifold 1', 2', 3', 4' is expanded by heat, the merging portion 7' is deformed to bend inwardly at the upper portion thereof, i.e., the merging portion 7' is deformed to decrease an angle between the central axis thereof and a general central axis of the exhaust ports. Therefore, a section of the merging portion 7' is crushed in the direction F2 at right angles to the mounting surface 10*a* of the cylinder head 10 and a large force is generated in the direction F2. In the present embodiment, each partition wall 7*a*', 7*b*', 7*c*', 7*d*' intersects a plane Y which is parallel to the direction F2 and passes through the center of the merging portion at about 45 degrees.

Figure 11:
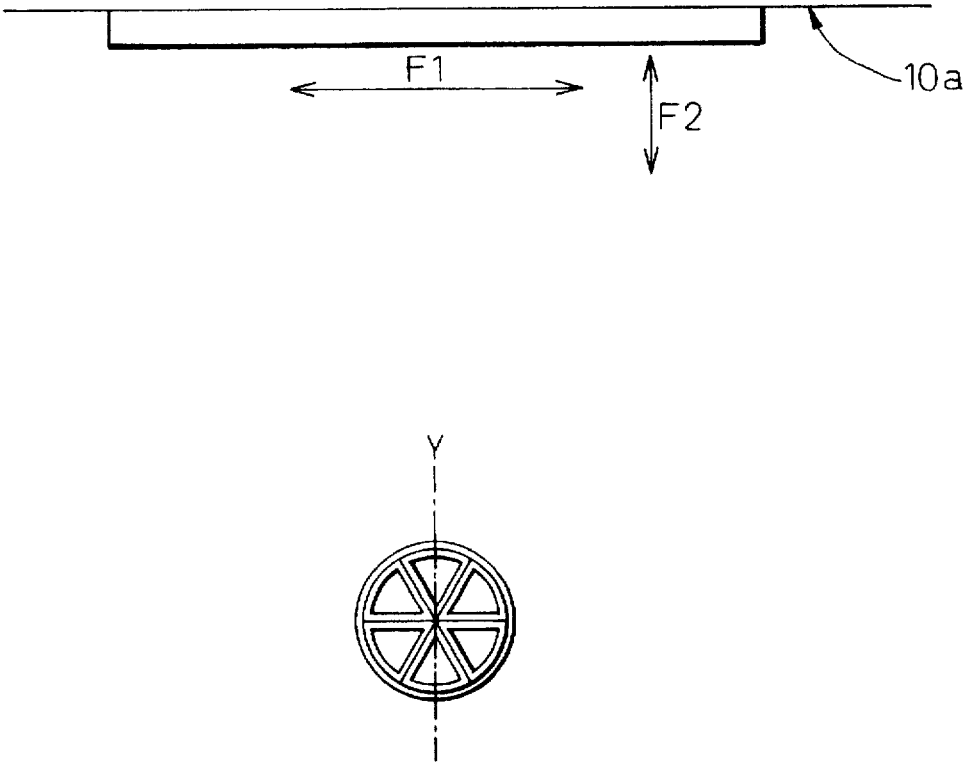
FIG. 11 is a horizontal sectional view of the merging portion when the exhaust manifold is for use with a six-cylinder engine, as a variation of the second embodiment.
Figure 12:
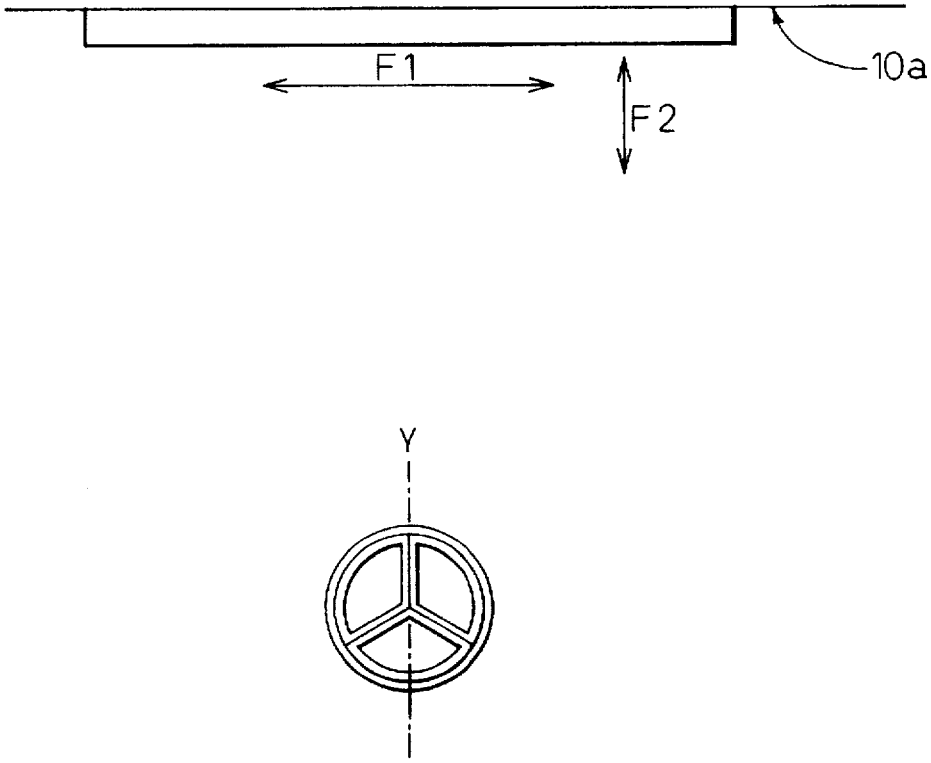
FIG. 12 is a horizontal sectional view of the merging portion when the exhaust manifold is for use with a three-cylinder engine, as a variation of the second embodiment.
Figure 13:
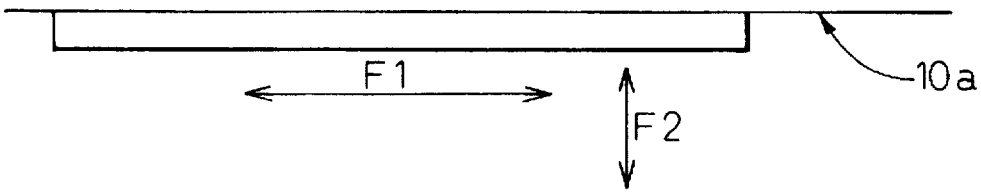
FIG. 13 is a horizontal sectional view of the merging portion when the exhaust manifold is for use with a five-cylinder engine, as a variation of the second embodiment.
Figure 13:
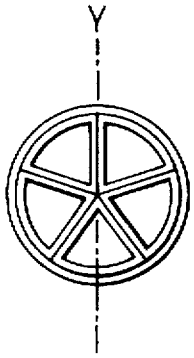

According to the second embodiment, in the exhaust manifold for a four-cylinder or an eight-cylinder engine, the arrangement of all partition walls in the merging portion of the second embodiment is the same as the arrangement of the first embodiment. However, in the exhaust manifold for an engine with a different number of cylinders, the arrangement of the partition walls in the merging portion of the second embodiment differs from the arrangement of the first embodiment. This is understood by comparison of FIG. 3 with FIG. 11 (when the exhaust manifold is for a six-cylinder engine), FIG. 5 with FIG. 12 (when the exhaust manifold is for a three-engine cylinder engine), and FIG. 6 with FIG. 13 (when the exhaust manifold is for a five-cylinder engine). In the second embodiment, since a force which acts on the partition walls 7*c*', 7*d*' of the merging portion is larger than a force which acts on the other partition walls, it is preferable that the end surface of the second exhaust port 2' is made to project and the partition walls 7*c*', 7*d*' are made strong by fillet welding.

In the above-mentioned two embodiments, the section shape of each exhaust port in the merging portion is a sector. However, the section shape of each exhaust port may be made a shape which has a wedge shape partly in the center portion in the merging portion, for example, a triangle shape. Moreover, it is not required that the areas of all exhaust ports are equal in the present invention.

Although the invention has been described with reference to specific embodiments thereof, it should be apparent that numerous modifications can be made thereto by those skilled in the art, without departing from the basic concept and scope of the invention.

We claim:

1. An exhaust manifold of which each exhaust port is formed by a pipe member, each said pipe member at one end portion has a wedge shape section, each said pipe member at the other end portion is connected to the cylinder head of an engine, said pipe members are abutted one another in said one end portion to form the merging portion of said exhaust manifold, a plurality of radial partition walls are formed in said merging portion by joining end surfaces of said pipe members one another, wherein two adjacent partition walls among said partitions walls are arranged almost symmetrically around a plane which passes through the center of said merging portion, and is parallel to a direction in which the largest force is generated by thermal expansions of said exhaust ports.

2. An exhaust manifold according to claim 1, wherein the end surface of only one pipe member is projected over the end surfaces of the other said pipe members in said merging portion.

3. An exhaust manifold according to claim 1, wherein four partition walls including said two adjacent partition walls are arranged almost symmetrically around said plane and a plane at right angles to said plane.

4. An exhaust manifold according to claim 1, wherein, when a horizontal distance between said cylinder head and said merging portion is shorter than a predetermined distance, said direction is a direction in which said other end portions of said pipe members are arranged.

5. An exhaust manifold according to claim 1, wherein, when a horizontal distance between said cylinder head and said merging portion is longer than a predetermined distance, said direction is a direction at right angles to a direction in which the other end portions of said pipe members are arranged.

6. An exhaust manifold according to claim 1, wherein the number of said pipe members is three.

7. An exhaust manifold according to claim 1, wherein the number of said pipe members is four.

8. An exhaust manifold according to claim 1, wherein the number of said pipe members is five.

9. An exhaust manifold according to claim 1, wherein the number of said pipe members is six.

10. An exhaust manifold according to claim 1, wherein the number of said pipe members is eight.

11. An exhaust manifold according to claim 2, wherein the number of said pipe members is four, and said only one pipe member is the shortest one.

12. An exhaust manifold according to claim 3, wherein the number of said pipe members is four.

13. An exhaust manifold according to claim 3, wherein the number of said pipe members is six.

14. An exhaust manifold according to claim 3, wherein the number of said pipe members is eight.

* * * * *

UNITED STATES PATENT AND TRADEMARK OFFICE

CERTIFICATE OF CORRECTION

PATENT NO. : 5,787,709

DATED : August 4, 1998

INVENTOR(S) : Yoshimasa WATANABE, et al.

It is certified that error appears in the above-indentified patent and that said Letters Patent is hereby corrected as shown below:

ABSTRACT, line 5, after "abutted" insert --to--.

ABSTRACT, line 9, after "members" insert --to--.

Column 1, line 18, after "abutted" insert --to--.

Column 2, line 2, after "members" insert --to--.

Column 2, line 4, change "partitions" to --partition--.

Column 3, line 3, after "abutted" insert --to--.

Column 3, line 27, change "acted" to --acting--.

Column 3, line 47, change "is" to --are--.

Column 4, line 49, delete "on".

Column 4, line 50, delete "on".

Column 5, line 4, change "relative" to --relatively--.

Column 5, line 26, change "anyone" to --any one--.

UNITED STATES PATENT AND TRADEMARK OFFICE

CERTIFICATE OF CORRECTION

PATENT NO. : 5,787,709
DATED : August 4, 1998
INVENTOR(S) : Yoshimasa WATANABE, et al.

It is certified that error appears in the above-indentified patent and that said Letters Patent is hereby corrected as shown below:

Column 6, line 9, change "three-engine cylinder engine" to --three cylinder engine--.

Column 6, line 33, after "abutted" insert --to--.

Column 6, line 37, after "members" insert --to--.

Signed and Sealed this
Fourth Day of April, 2000

*Attest:*

*Attesting Officer*

Q. TODD DICKINSON

*Director of Patents and Trademarks*